US006449008B1

(12) United States Patent
Hinchliffe

(10) Patent No.: US 6,449,008 B1
(45) Date of Patent: Sep. 10, 2002

(54) YARN MONITORING

(75) Inventor: Malcolm Geoffrey Hinchliffe, Macclesfield (GB)

(73) Assignee: The Merlin Partnership (GB)

( * ) Notice: Subject to any disclaimer, the term of this patent is extended or adjusted under 35 U.S.C. 154(b) by 0 days.

(21) Appl. No.: 09/359,481

(22) Filed: Jul. 22, 1999

(30) Foreign Application Priority Data

Jul. 30, 1998 (GB) ..... 9816604

(51) Int. Cl.[7] ..... H04N 7/18; G06K 9/00

(52) U.S. Cl. ..... 348/88; 73/160; 356/238.2; 382/111; 382/141

(58) Field of Search ..... 348/88; 382/111, 382/141; 356/238.2; 73/160; H04N 7/18

(56) References Cited

U.S. PATENT DOCUMENTS 4,213,056 A * 7/1980 Matsumura et al. ..... 73/160
5,671,061 A 9/1997 Hoeller ..... 356/429
5,910,187 A * 6/1999 Okuda et al. ..... 73/160

FOREIGN PATENT DOCUMENTS

EP 0578975 A1 1/1994 ..... G01N/33/36
EP 0816542 A2 1/1998 ..... D01H/13/26

* cited by examiner

*Primary Examiner*—Howard Britton
(74) *Attorney, Agent, or Firm*—Schwegman, Lundberg, Woessner & Kluth, P.A.

(57) ABSTRACT

Interlaced or twisted yarn is passed between an optical transmitter and receiver to produce an original signal which varies in response to the changes in dimension of the yarn. Such original signal is compared using cross-correlation with an expected signal as produced by an ideally processed yarn to produce a processed signal indicating by its value the degree of matching of the original signal with the expected signal. The amplitude of the processed signal is noted relative to a predetermined threshold value representing an acceptably processed yarn. The expected signal is devised by performing a frequency analysis on the original signal to establish a peak frequency which is used to determine the distance between nodes in an ideally processed yarn.

18 Claims, 2 Drawing Sheets

YARN MONITORING

FIELD OF THE INVENTION

This invention relates to the monitoring of synthetic textile yarns, and in particular to the monitoring of the interlace of an interlaced multifilament yarn, twist level in a twisted or cabled yarn or tension balance of a cabled yarn, hereinafter referred to as processed yarns.

BACKGROUND OF THE INVENTION

Historically, mechanical techniques, e.g. by pin insertion and thickness measurement, for the determination of the presence of interlace nodes in an interlaced multifilament yarn, twist levels in a cabled or twisted yarn or tension balance in a cabled yarn have been used in a laboratory. To improve on those techniques, optical techniques have been used for the measurement of the profile variation in textured, drawn or POY yarns due to the presence of interlace or twist nodes. The use of such optical techniques is well established, including laser/photo diode, LED/photo diode and laser/charge coupled diode(CCD). These optical techniques offer substantial advantages over the mechanical techniques since optical techniques are not speed limited and require minimum contact with the yarn, i.e. only guides to locate the yarn in the sensing device. However, to date the optical techniques have not offered the levels of accuracy obtainable using conventional mechanical techniques in the laboratory, to such an extent that in many cases they are used only to establish whether interlacing or twist is present in the yarn but not to measure the level of such interlacing or twist. The particular problems of the optical techniques used to date are their insensitivity to both tension variation and profile changes in the yarn not associated with interlace nodes or twist. These problems are particularly pronounced in the case of fine denier POY or drawn yarns, for which profile variations due to interlace nodes or twist are very small. In addition, significant variations in response have been encountered with time from a particular sensor, and from sensor to sensor. These problems have resulted in poor accuracy even in a laboratory where good controls are possible, and in consequence it has been impracticable to use such techniques for on-line monitoring of the interlacing or twist of synthetic textile yarns.

OBJECT OF THE INVENTION

It is an object of the present invention to provide a method of accurately measuring the interlace or twist level in a processed textile yarn which avoids or overcomes to a significant extent the problems described above in connection with conventional mechanical or optical techniques, and which can be used in a laboratory, at the process threadline, or for on-line monitoring.

SUMMARY OF THE INVENTION

The invention provides a method of monitoring the interlace or twists in a processed textile yarn, comprising forwarding the yarn past an optical transmitting and receiving device, recording the 'original' signal emitted by the receiving device, and using cross-correlation, comparing the original signal with a signal to be expected from monitoring an ideally processed yarn to produce a processed signal indicating by its value the degree of matching of the original signal with the expected signal.

The method may comprise noting the amplitude of the processed signal relative to a pre-determined threshold value representing acceptable interlace or twist nodes in the processed yarn to give the number and distribution of nodes in the yarn. In addition, the method may comprise adjusting the threshold value in accordance with the desired strength of the nodes. The threshold value may be adjusted between 60% and 140% of a nominal value, which may be 1.

The expected signal may be devised by performing a frequency analysis on the original signal to establish a peak frequency. The peak frequency may be used to determine the distance between nodes in an ideally processed yarn and to construct the form of the expected signal.

BRIEF DESCRIPTION OF THE DRAWINGS

The invention will now be described with reference to the accompanying drawings in which.

DESCRIPTION OF THE PREFERRED EMBODIMENTS

Figure 1:
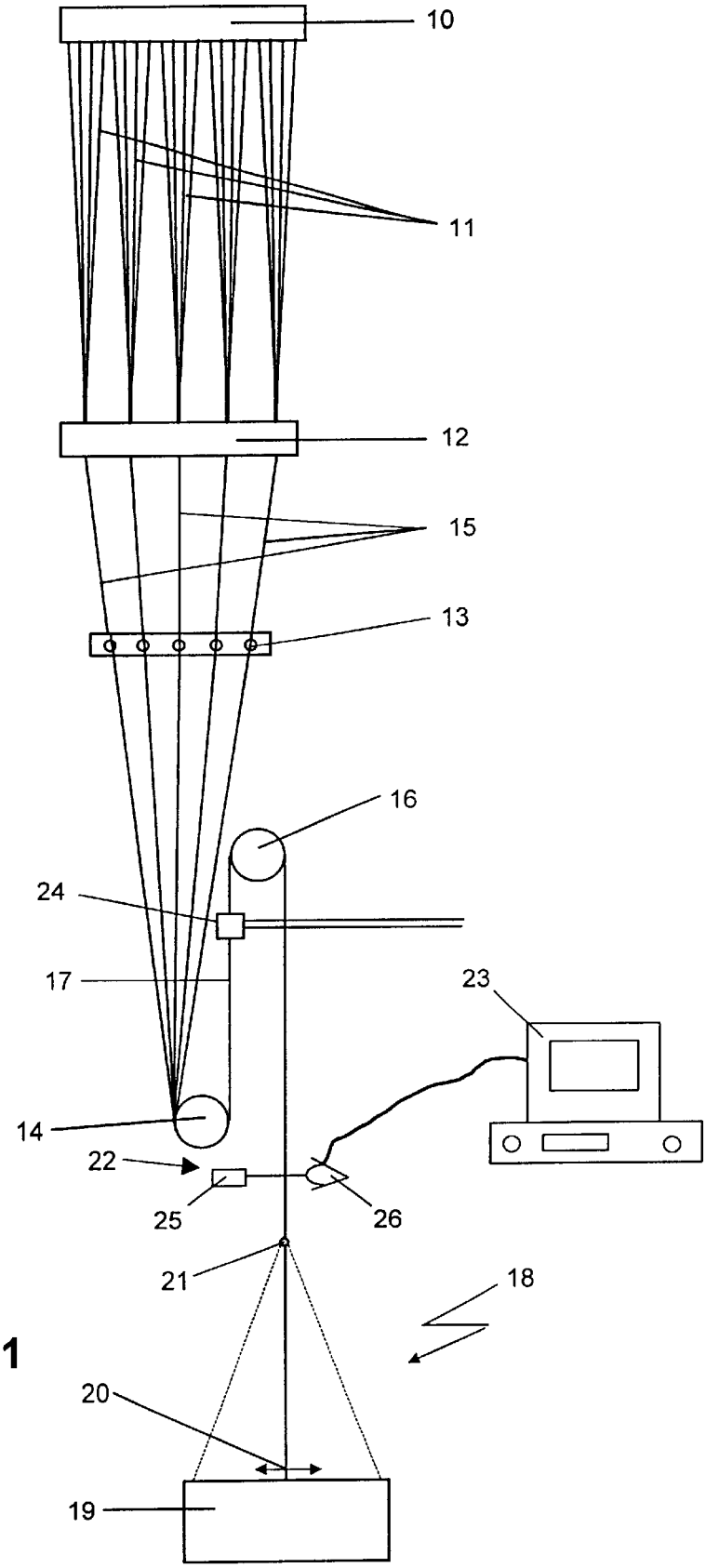
FIG. 1 illustrates the production and on-line monitoring of an interlaced POY yarn.

Referring now to FIG. 1, there is shown a spinneret 10 from which filaments 11 are extruded. Spin finish oil is applied to the filaments 11 by an oil applicator 12 at which the filaments 11 are brought together as yarns 15. The regularity of the oil application may be improved by oil dispersion jets 13. The filaments 11 / yarns 15 are drawn between the spinneret 10 and a first godet 14, and the resulting partially oriented yarn 15 is fed under controlled tension between that first godet 14 and a second godet 16. The partially oriented yarn 17 is then fed from a forwarding point 21 to a take up zone 18 to be wound on a package 19 using a traverse guide 20 which reciprocates as shown along a path parallel with the axis of the package 19. An air interlace jet 24, which directs a jet of air at the yarn 17 to interlace the filaments of the yarn 17, is disposed in between the first and second godets 14, 16 where the controlled tension is optimum for the interlacing process. An optical interlace sensor 22 is disposed between the second godet 16 and the forwarding point 21. The interlace sensor 22 comprises an optical transmitter 25 and an optical receiver 26, a beam from the transmitter 25 being directed at the yarn 17 and then being received by the receiver 26. The receiver 26 sends to a computing device 23 a signal which varies in response to the changes in dimension of the interlaced yarn 17, i.e. as interlace nodes pass the sensor 22. The invention is equally applicable to the monitoring of such a yarn at the process threadline or in a laboratory, for monitoring other types of yarn such as FDY, BCF, T&I, DTY and in other processes involving interlaced or twisted synthetic yarn such as draw-twist acetate processing, yarn twisting processes and cabling processes.

It has been established that the interlace or twist nodes in all types of synthetic textile yarns 17 occur at a particular frequency. This frequency varies very little in a given process, but there are substantial variations in this frequency between different processes. The factors affecting this frequency are: yarn denier, filament denier, yarn tension, yarn throughput speed, design of the air interlacing jet, twisting unit or cabling device, air pressure to the interlacing jet. As a result of this variation in frequency, the expected signal can vary considerably. It is important to establish the expected signal accurately, and this may be done in one of several ways. This may be done by iteration and skilled selection from a recorded signal, but preferably by performing a frequency analysis on the original signal from the monitored processed yarn. The resulting peak frequency is used to establish the distance between nodes in an ideally interlaced, twisted or cabled yarn to produce in turn the form of the expected signal.

Figure 2:
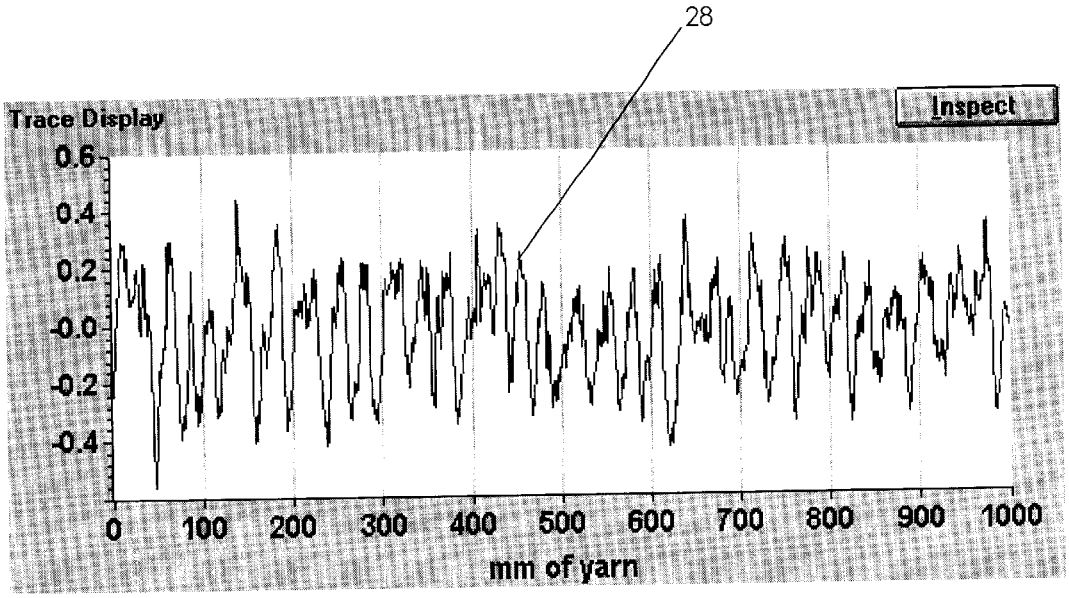
FIG. 2 shows a recording of an original signal from the optical receiving device.
Figure 3:
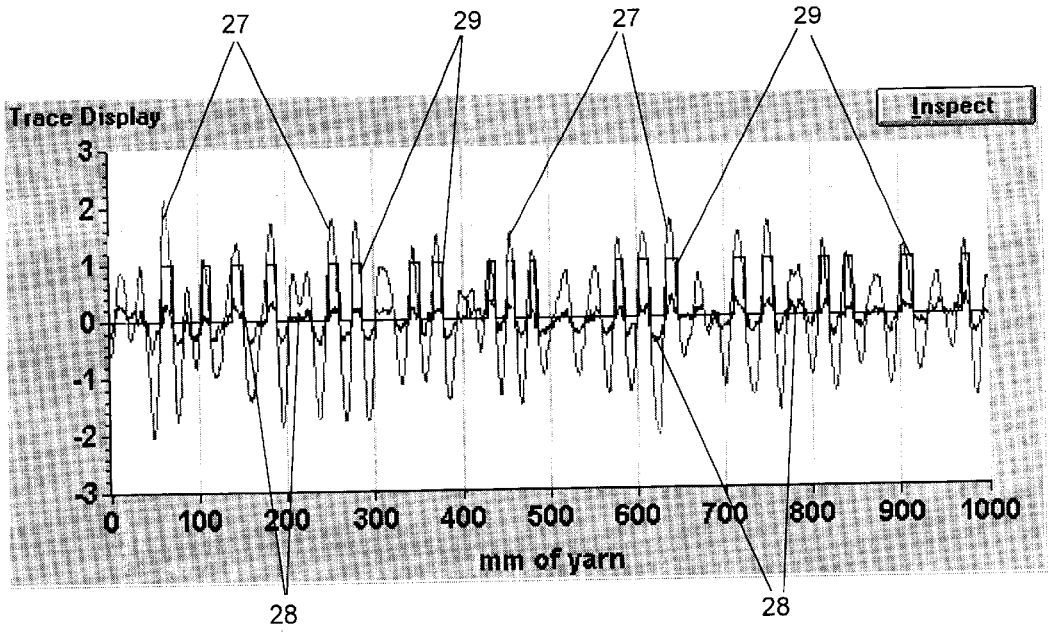
FIG. 3 shows a processed signal produced by comparing the original signal of FIG. 2 with an expected signal.

Such an original signal is shown in FIG. 2, in which the variation in thickness of the running interlaced, twisted or cabled yarn 17 is recorded against the length of yarn 17 passing between the transmitter 25 and receiver 26. The variation in thickness of the yarn 17 is represented by the amplitude of the signal. Once the frequency of this signal has been determined, it is possible to construct the form of an expected signal from an ideally processed yarn. The expected signal is cross-correlated with the original signal shown at 28 in FIG. 3 to a smaller scale than in FIG. 2. This produces a processed signal 27. The amplitude of this processed signal 27 indicates the quality or intensity of the interlace, twist or cable nodes in the yarn. By selecting the intensity required for acceptable nodes, i.e. the threshold value, the number and distribution of the nodes in the yarn can be established, as shown by the square wave trace 29. In this example, it has been taken that a threshold value of 1, when the two signals match, is regarded as an acceptable node. If a yarn producer requires stronger or weaker interlacing or twist or cabling level for a particular application, the threshold value can be adjusted to be less or greater than 1 respectively by up to ±40%, e.g. from 0.6 to 1.4. From this trace 29, the lengths of processed yarn 17 which have acceptable interlacing, twist or cabling and those that do not may be determined.

What is claimed is:

1. A method of monitoring a processed textile yarn having interlace or twist nodes therein, comprising forwarding the yarn past an optical transmitting and receiving device operable to emit signals, recording the "original" signal emitted by the receiving device as the yarn moves past the receiving device, and using cross-correlation, comparing the original signal with a signal to be expected from monitoring an ideally processed yarn to produce a processed signal indicating by its value the degree of matching of the original signal with the expected signal.

2. A method according to claim 1 wherein the processed signal has an amplitude, comprising noting the amplitude relative to a pre-determined threshold value representing acceptable interlace or twist nodes in the processed yarn to give the number and distribution of interlace or twist nodes in the yarn.

3. A method according to claim 2, comprising adjusting the threshold value in accordance with the desired strength of the nodes.

4. A method according to claim 3, wherein the threshold value is between 60% and 140% of a nominal value.

5. A method according to claim 4, wherein the nominal value of the threshold is 1.

6. A method according to claim 1, comprising devising the expected signal by performing a frequency analysis on the original signal.

7. A method according to claim 6, wherein a peak frequency is established from the frequency analysis.

8. A method according to claim 7 comprising determining the distance between nodes in an ideally processed yarn and constructing the form of the expected signal.

9. A method of monitoring a processed, moving yarn, comprising:

directing a beam at the moving yarn to produce a beam signal past the yarn; and using cross correlation, comparing the beam signal to an expected value for an ideal yarn.

10. The method of claim 9, wherein comparing the beam signal includes determining the expected value from the beam signal.

11. The method of claim 10, wherein determining the expected value includes performing a frequency analysis on the beam signal.

12. The method of claim 9, wherein comparing the beam signal to the expected value includes producing a processed signal that has an amplitude, noting the amplitude relative to a pre-determined threshold value representing acceptable interlace or twist nodes in the yarn to determine the number and distribution of interlace or twist nodes in the yarn.

13. The method of claim 12, wherein comparing includes adjusting the threshold value in accordance with a desired strength of the interlace or nodes in the yarn.

14. The method of claim 13, wherein comparing includes setting the threshold value between 60% and 140% of a nominal value.

15. The method of claim 14, wherein the nominal value of the threshold is 1.

16. The method of claim 9, wherein comparing includes devising the expected signal by performing a frequency analysis on the beam signal.

17. The method of claim 16, wherein devising the expected signal includes establishing a peak frequency from the frequency analysis.

18. The method of claim 17, wherein comparing includes determining a distance between nodes in an ideally processed yarn and constructing the form of the expected signal.

* * * * *